US007290377B2

(12) United States Patent
Dupuis

(10) Patent No.: US 7,290,377 B2
(45) Date of Patent: Nov. 6, 2007

(54) BLOCK CONNECTOR

(75) Inventor: Bruno Dupuis, Acton Vale (CA)

(73) Assignee: Rocvale Produits de Beton Inc., Acton Vale (CA)

( * ) Notice: Subject to any disclaimer, the term of this patent is extended or adjusted under 35 U.S.C. 154(b) by 0 days.

(21) Appl. No.: 11/469,537

(22) Filed: Sep. 1, 2006

(65) Prior Publication Data

US 2007/0074478 A1 Apr. 5, 2007

Related U.S. Application Data

(60) Provisional application No. 60/713,756, filed on Sep. 6, 2005.

(51) Int. Cl.

| | |
|---|---|
| ***E04B 1/02*** | (2006.01) |
| ***E04B 2/00*** | (2006.01) |
| ***E04B 1/00*** | (2006.01) |
| ***E04C 2/04*** | (2006.01) |

(52) U.S. Cl. ..... 52/564; 52/565; 52/568; 52/585.1; 52/604; 52/747.12

(58) Field of Classification Search ..... 52/582.1, 52/586.1, 586.2, 584.1, 585.1, 604, 285.1, 52/285.2, 285.3, 285.4, 603, 747.12, 747.1, 52/745.13, 562, 564, 565, 568; 24/287, 570; 446/85, 124, 108, 127, 109, 110, 111, 122, 446/123; 403/DIG. 8, 286, 292, 331, 13, 403/14, 387, 381; 405/286, 284, 262
See application file for complete search history.

(56) References Cited

U.S. PATENT DOCUMENTS

| | | | | | |
|---|---|---|---|---|---|
| 857,628 | A | * | 6/1907 | Jonas | 52/568 |
| 2,347,049 | A | * | 4/1944 | Green | 52/584.1 |
| 2,392,551 | A | * | 1/1946 | Roe | 52/586.2 |
| 2,645,114 | A | * | 7/1953 | Amirikian | 52/432 |
| 2,844,022 | A | * | 7/1958 | Klem | 52/592.5 |
| 3,037,593 | A | * | 6/1962 | Webster | 52/476 |
| D214,745 | S | * | 7/1969 | Walker | D21/488 |
| 4,474,504 | A | * | 10/1984 | Whitman et al. | 405/16 |
| 4,696,140 | A | * | 9/1987 | Marshall | 52/442 |
| 4,698,949 | A | * | 10/1987 | Dietrich | 52/415 |
| 4,808,140 | A | * | 2/1989 | Clavet | 446/127 |

(Continued)

FOREIGN PATENT DOCUMENTS

| | | |
|---|---|---|
| CA | 2007668 | 7/1990 |

(Continued)

*Primary Examiner*—Robert Canfield
*Assistant Examiner*—Ryan D Kwiecinski
(74) *Attorney, Agent, or Firm*—Goudreau Gage Dubuc

(57) ABSTRACT

A block connector for pre-cast building blocks comprising a top body portion to be fitted into the bottom surface groove of an upper block and a bottom body portion to be fitted into the top surface groove of a lower block. The top and bottom body portions define three pairs of lateral sides. When mounting the blocks about first pair of lateral sides no offset between the blocks is provided. When mounting the blocks about the second pair of lateral sides, an offset is provided. When mounting the blocks about the third pair of lateral sides, an offset is provided that is greater than the offset of the second pair of lateral sides. A kit for building walls including a plurality of these blocks and block connectors is also disclosed.

7 Claims, 6 Drawing Sheets

U.S. PATENT DOCUMENTS

| | | | | | |
|---|---|---|---|---|---|
| 4,896,999 | A | * | 1/1990 | Ruckstuhl | 405/286 |
| 4,920,712 | A | | 5/1990 | Dean, Jr. | |
| 4,926,595 | A | | 5/1990 | Dean, Jr. | |
| 5,083,706 | A | | 1/1992 | Bratchell | |
| 5,244,300 | A | * | 9/1993 | Perreira et al. | 403/381 |
| 5,252,017 | A | * | 10/1993 | Hodel | 411/446 |
| 5,619,835 | A | | 4/1997 | Bailey, II et al. | |
| 5,702,208 | A | | 12/1997 | Hilfiker et al. | |
| 5,797,706 | A | | 8/1998 | Segrestin et al. | |
| 5,820,305 | A | | 10/1998 | Taylor et al. | |
| 5,934,039 | A | * | 8/1999 | Guy | 52/747.12 |
| 6,050,749 | A | | 4/2000 | Khamis | |
| 6,089,792 | A | | 7/2000 | Khamis | |
| 6,280,121 | B1 | | 8/2001 | Khamis | |
| 6,287,054 | B1 | | 9/2001 | Egan et al. | |
| 6,357,960 | B1 | * | 3/2002 | Cornelius et al. | 403/381 |
| 6,443,663 | B1 | * | 9/2002 | Scales et al. | 405/262 |
| 6,447,211 | B1 | * | 9/2002 | Scales et al. | 405/262 |
| 6,701,687 | B1 | | 3/2004 | Shillingburg | |
| 6,739,797 | B1 | * | 5/2004 | Schneider | 404/35 |
| 7,152,383 | B1 | * | 12/2006 | Wilkinson et al. | 52/581 |
| 2004/0040249 | A1 | * | 3/2004 | Herbison | 52/677 |
| 2005/0081470 | A1 | | 4/2005 | Utsunomiya | |
| 2006/0165482 | A1 | * | 7/2006 | Olberding | 403/381 |
| 2006/0179780 | A1 | | 8/2006 | Price | |
| 2006/0283128 | A1 | | 12/2006 | Price et al. | |
| 2007/0074478 | A1 | | 4/2007 | Dupuis | |

FOREIGN PATENT DOCUMENTS

| | | |
|---|---|---|
| CA | 2082666 | 5/1993 |
| CA | 5114677 | 8/1995 |
| CA | 2306130 | 7/1999 |
| CA | 2265079 | 9/1999 |
| CA | 2414835 | 1/2002 |
| CA | 2495749 | 3/2004 |
| CA | 2513964 | 1/2007 |
| WO | WO 93/00484 | 1/1993 |
| WO | WO 93/23637 | 11/1993 |
| WO | WO 95/10667 | 4/1995 |
| WO | WO 95/33893 | 12/1995 |
| WO | WO 97/04903 | 2/1997 |
| WO | WO 98/40578 | 9/1998 |
| WO | WO 01/00932 | 1/2001 |
| WO | WO 01/17739 | 3/2001 |
| WO | WO 01/79620 | 10/2001 |
| WO | WO 02/02876 | 1/2002 |
| WO | WO 02/101157 | 12/2002 |
| WO | WO 03/006748 | 1/2003 |
| WO | WO 03/006749 | 1/2003 |
| WO | WO 2004/018779 | 3/2004 |
| WO | WO 2004/104313 | 12/2004 |
| WO | WO 2005/042862 | 5/2005 |
| WO | WO 2006/012230 | 2/2006 |
| WO | WO 2006/053224 | 5/2006 |
| WO | WO 2006/053235 | 5/2006 |
| WO | WO 2006/057986 | 6/2006 |
| WO | WO 2006/080699 | 8/2006 |
| WO | WO 2006/092019 | 9/2006 |
| WO | WO 2006/093540 | 9/2006 |

* cited by examiner

BLOCK CONNECTOR

CROSS REFERENCE TO RELATED APPLICATIONS

This application claims priority on U.S. provisional application No. 60/713,756, filed on Sep. 6, 2005. All documents above are herein incorporated by reference.

FIELD OF THE INVENTION

The present invention relates to a block connector. More specifically, the present invention is concerned with a block connector for connecting pre-cast building blocks together.

SUMMARY OF THE INVENTION

More specifically, there is provided a block connector for pre-cast blocks having a top surface including a top groove and a bottom surface including a bottom groove, the block connector, comprising: a top body portion for fitting into the bottom groove of an upper pre-cast block; a bottom body portion for fitting into the top groove of a lower pre-cast block; a first pair of opposite lateral sides, each of the first pair of opposite lateral sides being defined by a first surface portion of the top body portion and a second surface portion of the bottom body portion, the first and second surface portions of each of the first pair of the lateral sides being flush; a second pair of opposite lateral sides, each of the second pair of opposite lateral sides being defined by a first surface portion of the top body portion and a second surface portion of the bottom body portion, the first and second surface portions of each the second pair of the lateral sides being separated by a first offset; and a third pair of opposite lateral sides, each of the third pair of opposite lateral sides being defined by a first surface portion of the top body portion and a second surface portion of the bottom body portion, the first and second surface portions of each the third pair of the lateral sides being separated by a second offset; wherein the top body portion engages the bottom groove of an upper pre-cast block and the bottom body portion engages the top groove of a lower pre-cast block.

There is further provided a block connector for pre-cast blocks having a top surface including a top groove and a bottom surface including a bottom groove, the block connector comprising: a top body portion; and a bottom body portion; each one of the top body portion and the bottom body portion comprising three lateral sides separated by truncated corners; wherein the top body portion engages the bottom groove of an upper pre-cast block and the bottom body portion engages the top groove of a lower pre-cast block.

There is further provided a kit for building a retaining wall, comprising: a plurality of pre-cast blocks, each block having a top surface including a top central groove and a bottom surface including a bottom central groove; and a plurality of block connectors for connecting two of the plurality of blocks stacked together, each block connector comprising: a top body portion for fitting into the bottom groove of an upper pre-cast block; a bottom body portion for fitting into the top groove of a lower pre-cast block; a first pair of opposite lateral sides, each of the first pair of opposite lateral sides being defined by a first surface portion of the top body portion and a second surface portion of the bottom body portion, the first and second surface portions of each the first pair of the lateral sides being flush; a second pair of opposite lateral sides, each of the second pair of opposite lateral sides being defined by a first surface portion of the top body portion and a second surface portion of the bottom body portion, the first and second surface portions of each the second pair of the lateral sides being equally offset; and a third pair of opposite lateral sides, each of the third pair of opposite lateral sides being defined by a first surface portion of the top body portion and a second surface portion of the bottom body portion, the first and second surface portions of each the third pair of the lateral sides being equally offset; the offset of the third pair of lateral sides being greater than the offset of the second pair of opposite lateral sides; wherein when stacking the two blocks about the first pair of opposite lateral sides the two stacked blocks provide a flush surface, when stacking two blocks about the second pair of opposite lateral sides the two stacked blocks provide an offset surface equal to the offset of the second pair of opposite lateral sides, and when stacking two blocks about the third pair of opposite lateral sides the two stacked blocks provide an offset surface equal to the offset of the third pair of opposite lateral sides.

There is further provided a method for connecting pre-cast blocks having a top surface including a top groove and a bottom surface including a bottom groove, comprising the steps of: providing a top body portion; providing a bottom body portion; assembling said top and bottom body portions into a block connector having: i) a first pair of opposite lateral sides, each of the first pair of opposite lateral sides being defined by a first surface portion of the top body portion and a second surface portion of the bottom body portion, the first and second surface portions of each of the first pair of the lateral sides being flush; ii) a second pair of opposite lateral sides, each of the second pair of opposite lateral sides being defined by a first surface portion of the top body portion and a second surface portion of the bottom body portion, the first and second surface portions of each the second pair of the lateral sides being separated by a first offset; and iii) a third pair of opposite lateral sides, each of the third pair of opposite lateral sides being defined by a first surface portion of the top body portion and a second surface portion of the bottom body portion, the first and second surface portions of each the third pair of the lateral sides being separated by a second offset; and engaging the top body portion with the bottom groove of an upper pre-cast block and the bottom body portion with the top groove of a lower pre-cast block.

There is further provided a method for connecting pre-cast blocks having a top surface including a top groove and a bottom surface including a bottom groove, comprising the steps of: providing a top body portion with three lateral sides separated by truncated corners; providing a bottom body with three lateral sides separated by truncated corners; and engaging the top body portion engages with the bottom groove of an upper pre-cast block and the bottom body portion with the top groove of a lower pre-cast block.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Figure 1:
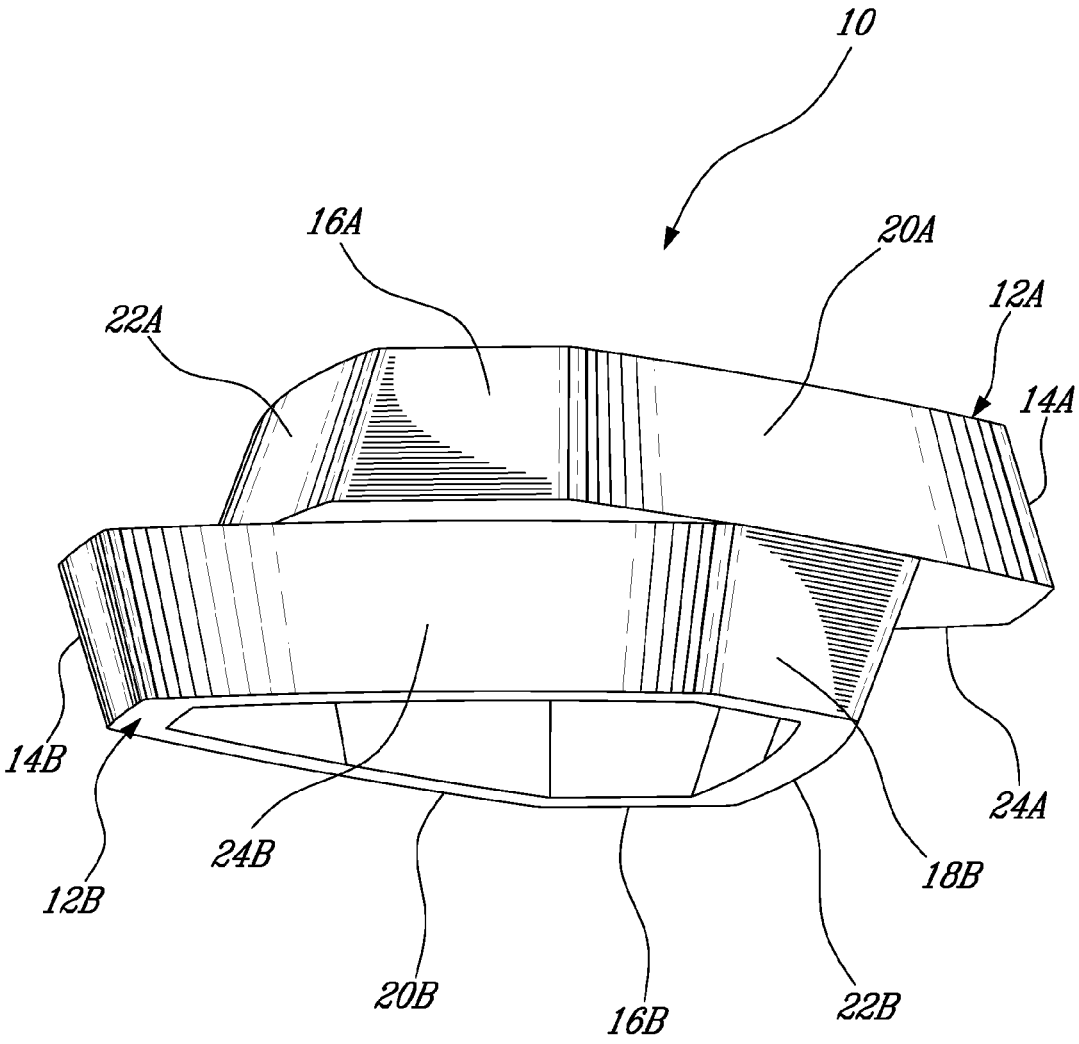
FIG. 1 is a lateral perspective view of the block connector of the present invention in accordance with an embodiment thereof.
Figure 2:
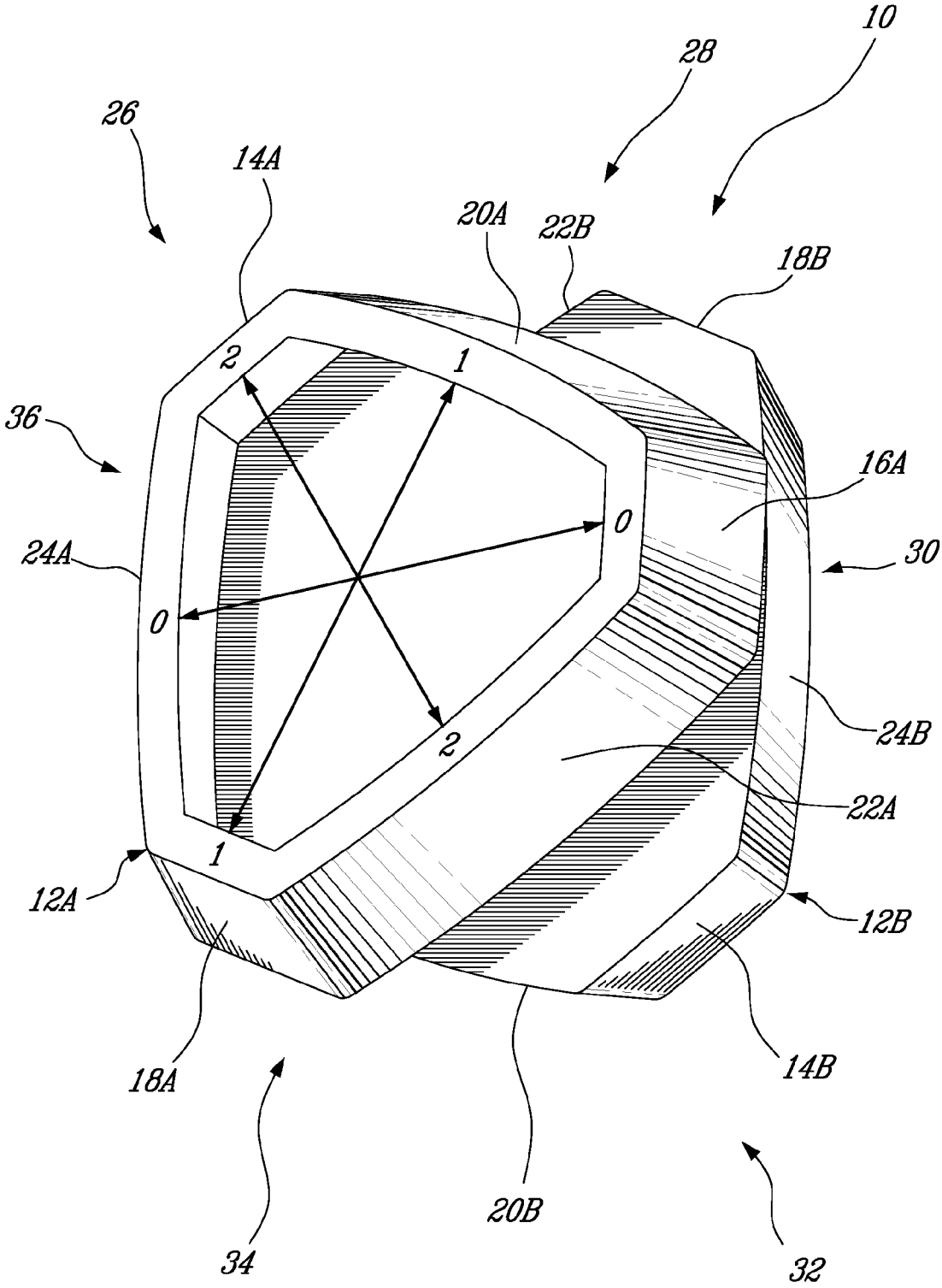
FIG. 2 is a top perspective view of the block connector of FIG. 1.

FIGS. 1 and 2 show a block connector 10 in accordance with an embodiment of the present invention. The block connector 10 comprises a top body portion 12A and an offset bottom body portion 12B.

The top and bottom body portions 12A and 12B are similarly configured and sized. Each body portion 12A and 12B is a solid triangle like body respectively, each having truncated angles 14A, 16A, 18A and 14B, 16B, 18B forming flat corners between three larger lateral sides 20A, 22A 24A and 20B, 22B, 24B respectively. Hence, body portion 12A comprises lateral sides 14A, 20A, 16A, 22A, 18A and 24A. Body portion 12B comprises lateral sides 14B, 20B, 16B, 22B, 18B and 24B.

Figure 4A:
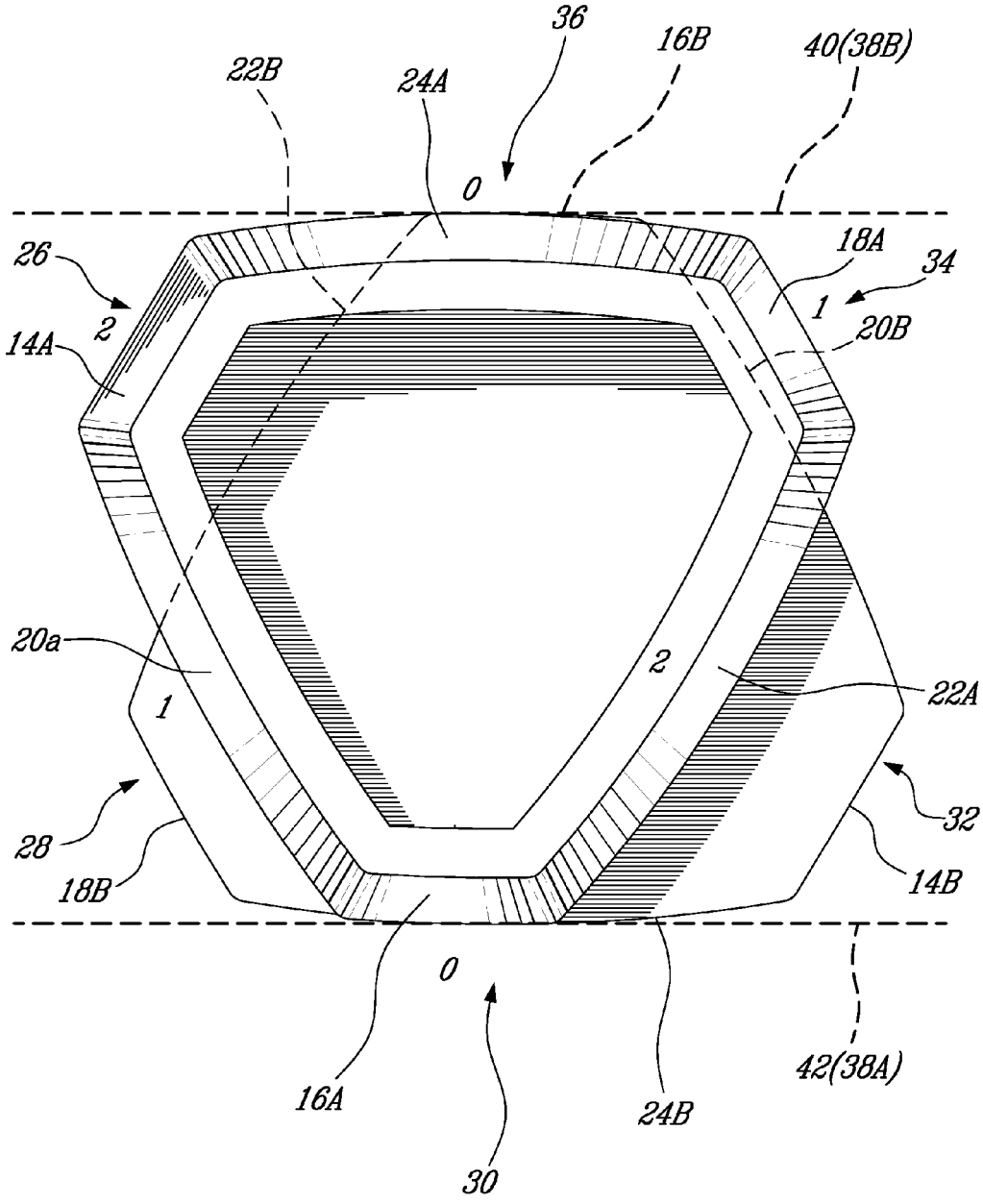
FIGS. 4A, 4B and 4C are top views of the block connector of the present invention showing the positioning of blocks in dotted line about this block connector.

The top and bottom body portions are assembled into a block connector 10 having six sides, as seen in FIGS. 2 and 4A, namely: a first side 26, formed by offset surfaces 14A and 22B of top and bottom body portions respectively; a second side 28 formed by surfaces offset surfaces 20A and 18B of top and bottom body portions respectively; a third side 30 formed by flush surfaces 16A and 24B of top and bottom body portions respectively; a fourth side 32 formed by offset surfaces 22A and 14B of top and bottom body portions respectively; a fifth side 34 formed by offset surfaces 18A and 20B of top and bottom body portions respectively; a sixth side 36 formed by flush surfaces 24A and 16B of top and bottom body portions respectively.

Figure 3:
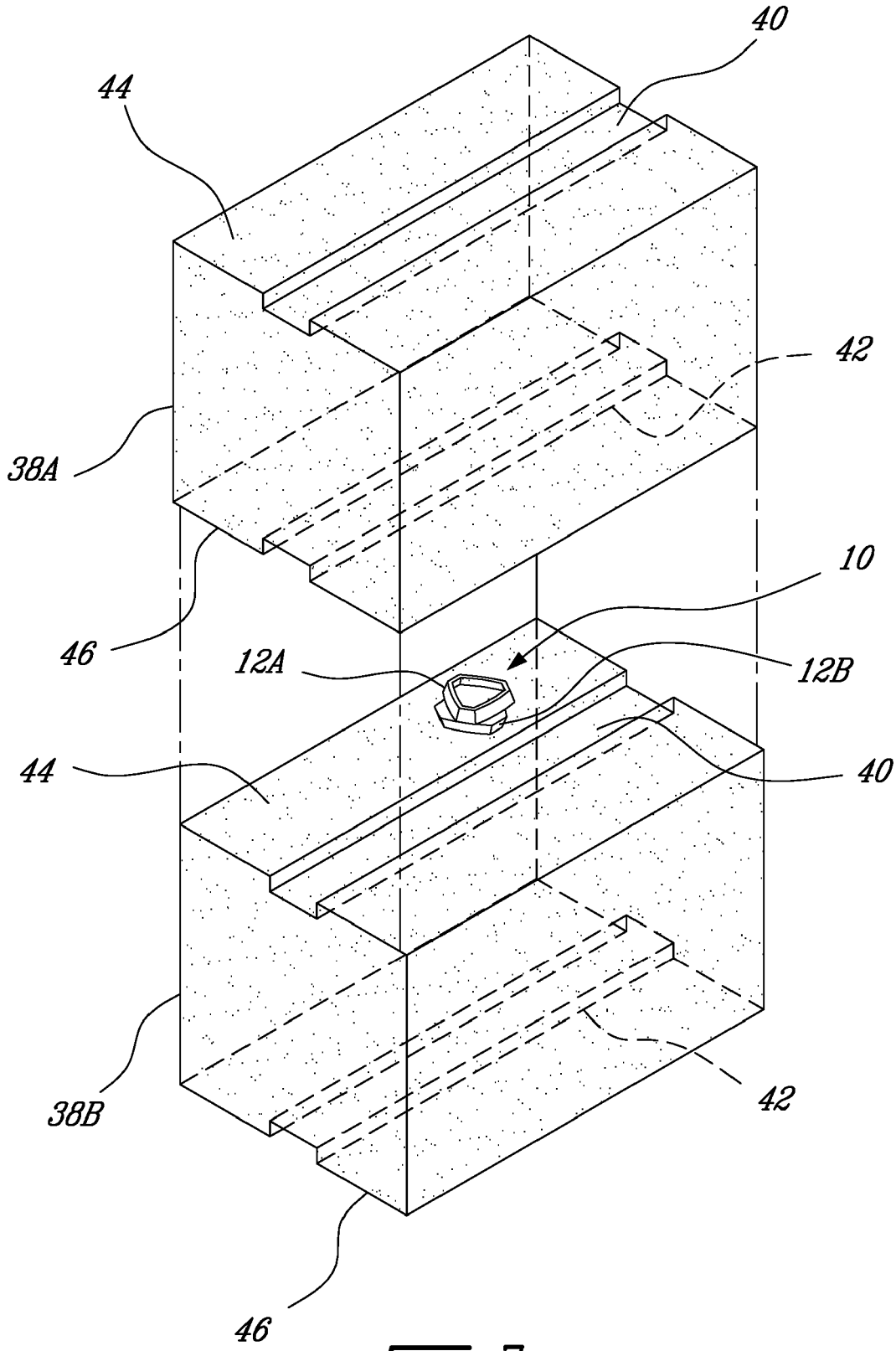
FIG. 3 is a perspective view of the block connector of FIG. 1 placed between two pre-cast building blocks.
Figure 4B:
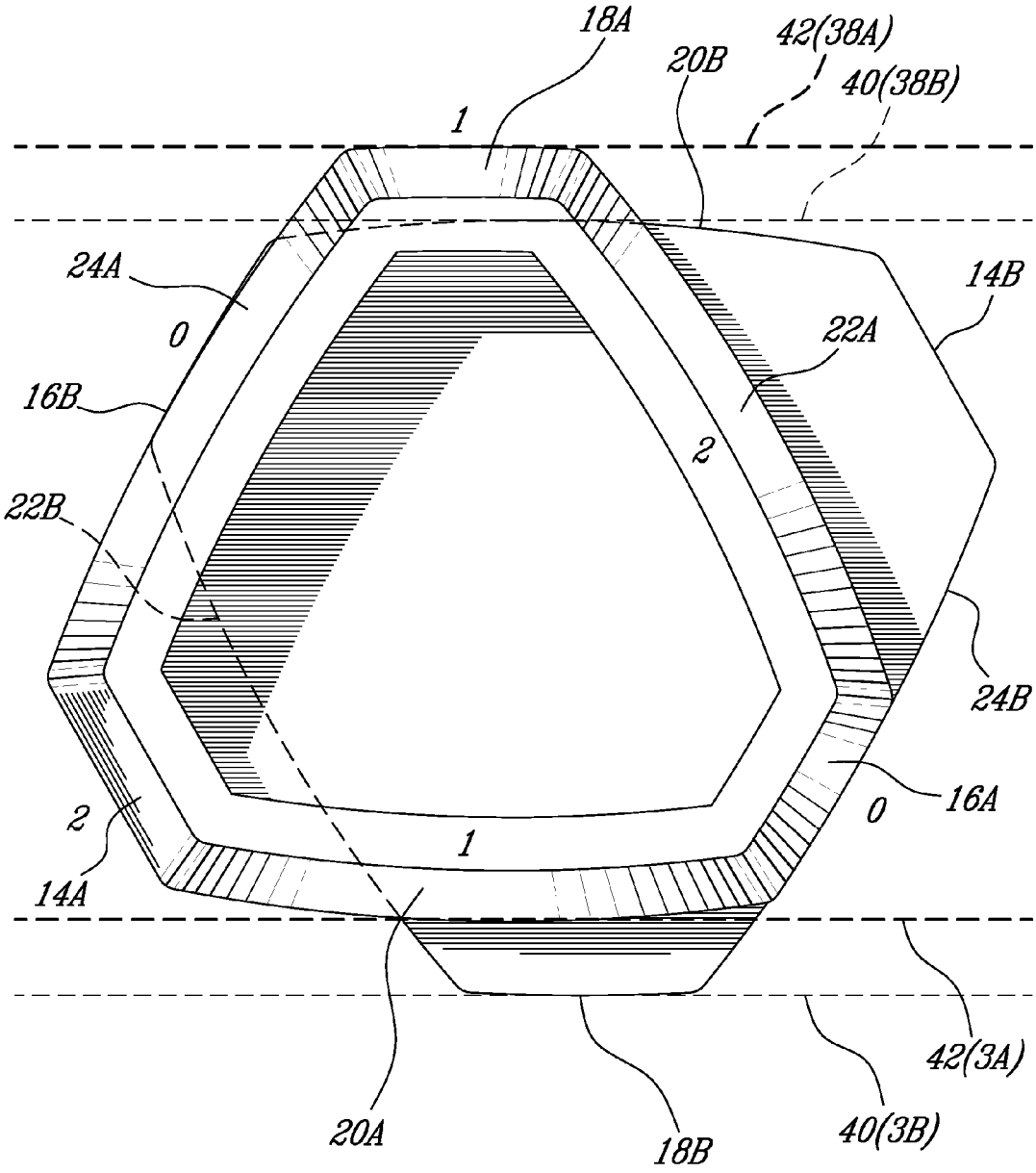
Figure 4C:
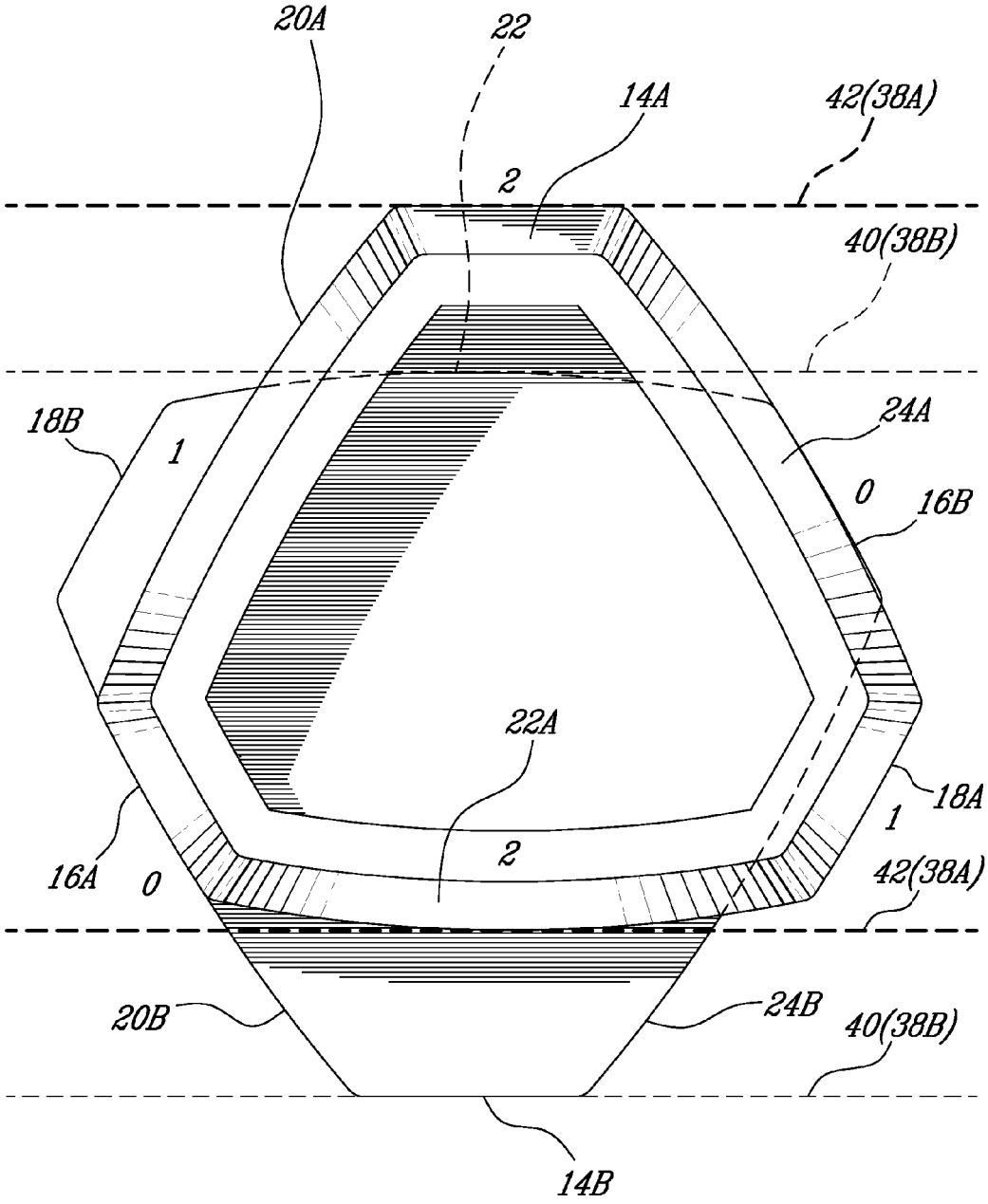

FIG. 3 shows a pair of top and bottom blocks 38A and 38B, each block has top and bottom grooves 40 and 42 respectively on their top and bottom surfaces 44 and 46 respectively. The block connector 10 serves to connect two blocks 38A and 38B together as shown in FIGS. 4A, 4B and 4C. More specifically, body portion 12A is fitted into the bottom groove 42 of a top block 38A and body portion 12B is fitted in the top groove 40 of a bottom block 38B.

With respect to FIG. 2, the top and bottom body portions 12A and 12B form three positioning axes. For the top body portion 12A, axis 0-0 is defined between lateral sides 24A and 16A, axis 2-2 is defined between lateral sides 22A and 14A, axis 1-1 is defined between lateral sides 24A and 20A. For body portion 12B, axis 0-0 is defined between lateral sides 24B and 16B, axis 2-2 is defined between lateral sides 22B and 14B, axis 1-1 is defined between lateral sides 24B and 20B. These three provide for positioning the blocks 38A and 38B in three different positions on body portions 12A and 12B respectively FIG. 4A shows groove 42 of top block 38A mounted about axis 0-0 defined by opposite lateral sides 24A and 16A, groove 40 of block 38B is mounted about an axis 0-0 defined by opposite lateral sides 24B and 16B, hence, there is no offset between blocks 38A and 38B.

FIG. 4B shows groove 42 of top block 38A mounted about axis 1-1 defined by opposite lateral sides 20A and 18A, groove 40 of block 38B is mounted about an axis 1-1 defined by opposite lateral sides 20B and 18B, hence, there is a small offset between blocks 38A and 38B defined by the offset between surfaces 20B and 18A, which is equal to the offset between surfaces 18B and 20A.

FIG. 4C shows groove 42 of top block 38A mounted about axis 2-2 defined by opposite lateral sides 22A and 14A, groove 40 of block 38B is mounted about an axis 2-2 defined by opposite lateral sides 22B and 14B, hence, there is a large offset between blocks 38A and 38B defined by the offset between surfaces 22B and 14A, which is equal to the offset between surfaces 14B and 22A.

Although the present invention has been described hereinabove by way of specific embodiments thereof, it can be modified, without departing from the spirit and nature of the subject invention as defined in the appended claims.

What is claimed is:

1. A block connector for pre-cast blocks having a top surface including a top groove and a bottom surface including a bottom groove, the block connector, comprising:

a top body portion for fitting into the bottom groove of an upper pre-cast block;

a bottom body portion for fitting into the top groove of a lower pre-cast block;

a first pair of opposite lateral sides, each of the first pair of opposite lateral sides being defined by a first surface portion of the top body portion and a second surface portion of the bottom body portion, the first and second surface portions of each of the first pair of the lateral sides being flush;

a second pair of opposite lateral sides, each of the second pair of opposite lateral sides being defined by a first surface portion of the top body portion and a second surface portion of the bottom body portion, the first and second surface portions of each the second pair of the lateral sides being separated by a first offset; and a third pair of opposite lateral sides, each of the third pair of opposite lateral sides being defined by a first surface portion of the top body portion and a second surface portion of the bottom body portion, the first and second surface portions of each the third pair of the lateral sides being separated by a second offset;

wherein said top body portion engages the bottom groove of an upper pre-cast block and said bottom body portion engages the top groove of a lower pre-cast block.

2. A block connector for pre-cast blocks having a top surface including a top groove and a bottom surface including a bottom groove, the block connector comprising:

a top body portion; and a bottom body portion; each one of said top body portion and said bottom body portion comprising three lateral sides separated by truncated corners;

wherein said top body portion engages the bottom groove of an upper pre-cast block and said bottom body portion engages the top groove of a lower pre-cast block.

3. The block connector of claim 2, wherein, in relation to each one of said top and bottom body portions, a first axis is defined between a first lateral side and a first truncated corner opposite said first lateral side, a second axis is defined between a second lateral side and a second truncated corner opposite said second lateral side, and a third axis is defined between a third lateral side and a third truncated corner opposite said third lateral side; the block connector being mounted between the upper and the lower pre-cast blocks according to one position selected between:

i) the bottom groove of said upper pre-cast block is mounted about the first axis of said top body portion, and the upper groove of said lower pre-cast block is mounted about the first axis of said bottom body portion, resulting in said two pre-cast blocks being connected without offset;

ii) the bottom groove of said upper pre-cast block is mounted about the second axis of said top body portion and the upper groove of said lower pre-cast block is mounted about the second axis of said bottom body portion, resulting in said two pre-cast blocks being connected with a first offset; and iii) the bottom groove of said upper pre-cast block is mounted about the third axis of said top body portion and the upper groove of said lower pre-cast block is mounted about the third axis of said bottom body portion, resulting in said two pre-cast blocks being connected with a second offset.

4. A kit for building a retaining wall, comprising:

a plurality of pre-cast blocks, each block having a top surface including a top central groove and a bottom surface including a bottom central groove; and a plurality of block connectors for connecting two of said plurality of blocks stacked together, each block connector comprising:

a top body portion for fitting into the bottom groove of an upper pre-cast block;

a bottom body portion for fitting into the top groove of a lower pre-cast block;

a first pair of opposite lateral sides, each of the first pair of opposite lateral sides being defined by a first surface portion of the top body portion and a second surface portion of the bottom body portion, the first and second surface portions of each the first pair of the lateral sides being flush;

a second pair of opposite lateral sides, each of the second pair of opposite lateral sides being defined by a first surface portion of the top body portion and a second surface portion of the bottom body portion, the first and second surface portions of each the second pair of the lateral sides being equally offset; and a third pair of opposite lateral sides, each of the third pair of opposite lateral sides being defined by a first surface portion of the top body portion and a second surface portion of the bottom body portion, the first and second surface portions of each the third pair of the lateral sides being equally offset; the offset of the third pair of lateral sides being greater than the offset of the second pair of opposite lateral sides;

wherein when stacking the two blocks about the first pair of opposite lateral sides the two stacked blocks provide a flush surface, when stacking two blocks about the second pair of opposite lateral sides the two stacked blocks provide an offset surface equal to the offset of the second pair of opposite lateral sides, and when stacking two blocks about the third pair of opposite lateral sides the two stacked blocks provide an offset surface equal to the offset of the third pair of opposite lateral sides.

5. A method for connecting pre-cast blocks having a top surface including a top groove and a bottom surface including a bottom groove, comprising the steps of:

providing a top body portion;

providing a bottom body portion;

assembling said top and bottom body portions into a block connector having: i) a first pair of opposite lateral sides, each of the first pair of opposite lateral sides being defined by a first surface portion of the top body portion and a second surface portion of the bottom body portion, the first and second surface portions of each of the first pair of the lateral sides being flush; ii) a second pair of opposite lateral sides, each of the second pair of opposite lateral sides being defined by a first surface portion of the top body portion and a second surface portion of the bottom body portion, the first and second surface portions of each the second pair of the lateral sides being separated by a first offset; and iii) a third pair of opposite lateral sides, each of the third pair of opposite lateral sides being defined by a first surface portion of the top body portion and a second surface portion of the bottom body portion, the first and second surface portions of each the third pair of the lateral sides being separated by a second offset; and engaging the top body portion with the bottom groove of an upper pre-cast block and the bottom body portion with the top groove of a lower pre-cast block.

6. A method for connecting pre-cast blocks having a top surface including a top groove and a bottom surface including a bottom groove, comprising the steps of:

providing a top body portion with three lateral sides separated by truncated corners;

providing a bottom body with three lateral sides separated by truncated corners; and engaging the top body portion with the bottom groove of an upper pre-cast block and the bottom body portion with the top groove of a lower pre-cast block.

7. The method of claim 6, a first axis being defined between a first lateral side and a first truncated corner opposite said first lateral side, a second axis bring defined between a second lateral side and a second truncated corner opposite said second lateral side, and a third axis being defined between a third lateral side and a third truncated corner opposite said third lateral side, in relation to each one of the top and bottom body portions, said step of engaging the top body portion with the bottom groove of the upper pre-cast block and the bottom body portion with the top groove of the lower pre-cast block comprising one of:

i) mounting the bottom groove of the upper pre-cast block about the first axis of the top body portion, and mounting the upper groove of said lower pre-cast block about the first axis of the bottom body portion, whereby the two pre-cast blocks are connected without offset;

ii) mounting the bottom groove of the upper pre-cast block about the second axis of the top body portion and mounting the upper groove of the lower pre-cast block about the second axis of the bottom body portion, whereby the two pre-cast blocks are connected with a first offset; and iii) mounting the bottom groove of the upper pre-cast block about the third axis of the top body portion and mounting the upper groove of the lower pre-cast block about the third axis of the bottom body portion, whereby the two pre-cast blocks are connected with a second offset.

* * * * *